United States Patent [19]

Cox

[11] 4,197,670

[45] Apr. 15, 1980

[54] DOLL WITH POUCH

[76] Inventor: Zula B. Cox, Rte. 1 - Box 5A, Folsom, La. 70437

[21] Appl. No.: 949,363

[22] Filed: Oct. 6, 1978

[51] Int. Cl.[2] ..... A63H 3/02; G09B 23/30

[52] U.S. Cl. ..... 46/153; 35/17; 46/DIG. 1; 46/151

[58] Field of Search ..... 46/153, 116, DIG. 1, 46/151, 161; 35/17

[56] References Cited

U.S. PATENT DOCUMENTS

| | | | |
|---|---|---|---|
| D. 226,101 | 1/1973 | Marcus | 46/153 |
| 1,445,368 | 2/1923 | Street et al. | 46/116 |
| 1,543,351 | 6/1925 | Webb | 46/153 |
| 2,551,560 | 5/1951 | Graves | 46/161 |
| 2,591,379 | 4/1952 | Schradermeier | 46/116 |
| 2,678,505 | 5/1954 | Munson | 46/151 |
| 3,546,789 | 12/1970 | Kushell | 46/153 |

FOREIGN PATENT DOCUMENTS

| | | | |
|---|---|---|---|
| 1430513 | 3/1976 | United Kingdom | 46/DIG. 1 |

*Primary Examiner*—Louis G. Mancene
*Assistant Examiner*—Michael J. Foycik
*Attorney, Agent, or Firm*—Sughrue, Rothwell, Mion, Zinn and Macpeak

[57] ABSTRACT

An educational toy is a doll of the stuffed variety having a fabric cover. The doll includes a trunk and body appendages, and the trunk has a cavity therein. A fabric door is hingedly connected to cover the cavity, and has indicia thereon. A baby doll is removably carried within the cavity.

Self adherent patches are located at selected positions on the assembly whereby the baby doll is attachable to the main doll body.

3 Claims, 7 Drawing Figures

DOLL WITH POUCH

BACKGROUND OF THE INVENTION

1. Field of the invention:

This invention relates to an amusement and educational device in the form of a stuffed toy doll having an educational purpose in graphically depicting in general terms to young children the birth process.

2. Statement of the Prior Art

Prior proposals in this area, in which dolls with reclosable body cavities are shown, include those disclosed in the below listed prior U.S. patents:

| Patentee | Patent No. | Date |
|---|---|---|
| J. A. Street et al | 1,445,368 | Feb. 13, 1923 |
| J. O. Graves | 2,551,560 | May 1, 1951 |
| L. M. Schradermeier | 2,591,379 | April 1, 1952 |
| H. J. Munson | 2,678,505 | May 18, 1954 |

SUMMARY OF THE INVENTION

The present invention is directed to an educational toy simulating a mother and child, and which generally indicates the birth process. The toy includes a mother doll and a baby doll, the mother having a pouch in the adominal area in which the baby may be stored in fetal position. A door or flap covers the pouch, and is held in place by strips of adherent material, such as that sold under the trademark VELCRO.

The door contains informative indicia, such as wording indicating the presence of the baby therein.

Other strips of VELCRO material are provided at different locations on both the mother and baby dolls for temporary positioning of the components.

Other and further objects and advantages of this invention will become apparent to those skilled in the art from a consideration of the following specification when read in conjunction with the annexed drawings.

Figure 1:
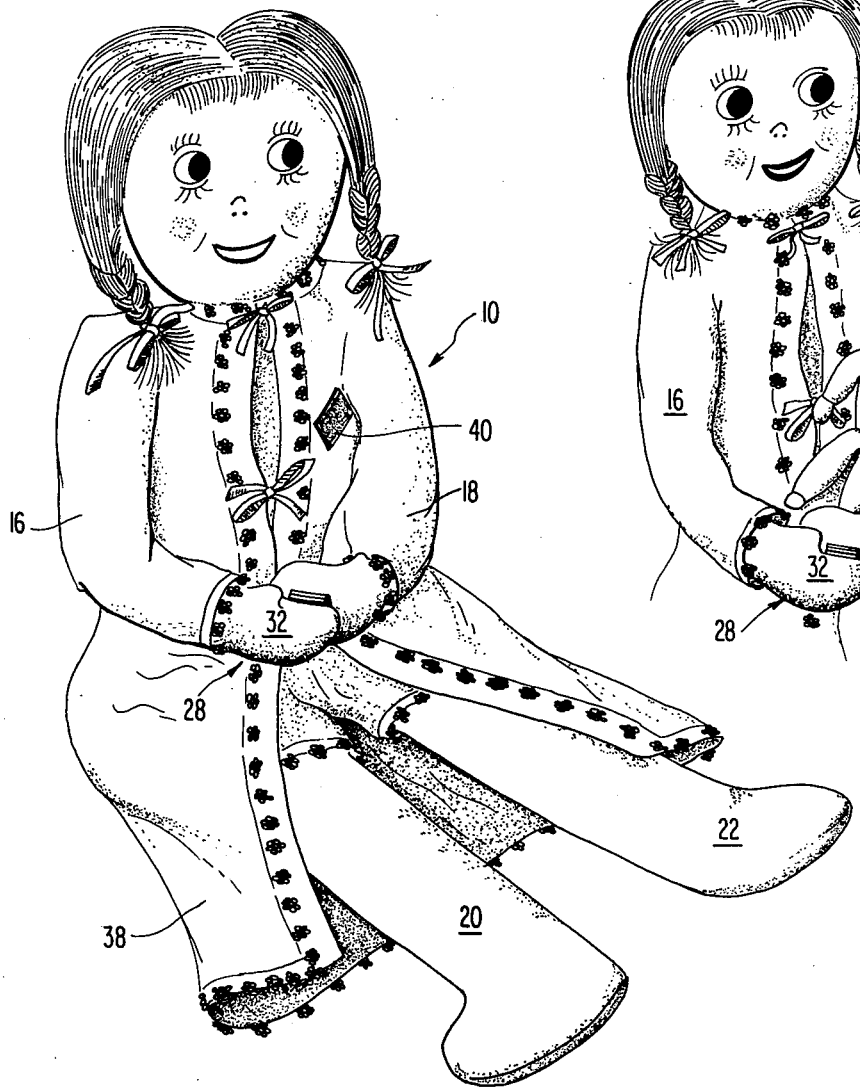
FIG. 1 is a perspective view showing a doll constructed and assembled in accordance with this invention.

DESCRIPTION OF THE PREFERRED EMBODIMENT:

Referring to the drawing in more detail, an educational doll according to this invention is therein generally identified by reference character 10. The doll 10 comprises a main doll body 12 of the stuffed fabric type having a trunk portion 14, a pair of arms 16 and 18 and legs 20 and 22. Each of said portions is provided with a fabric cover 24, and each is stuffed with a filler material 26 such as cotton fibers or the like.

Figure 2:
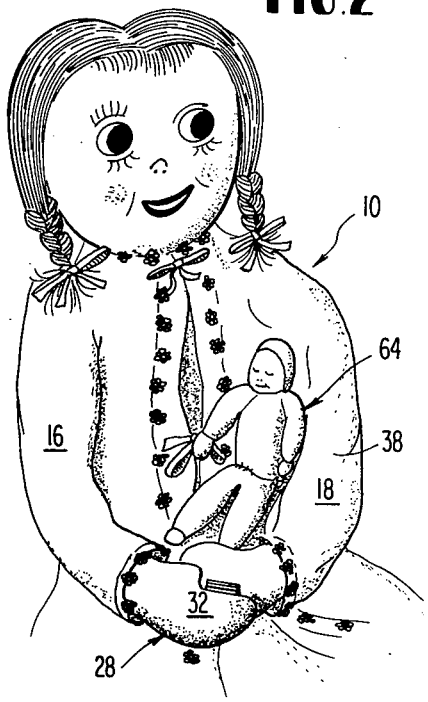
FIG. 2 is a partial view of the mother doll, with the baby doll hereof in one alternative position.
Figure 3:
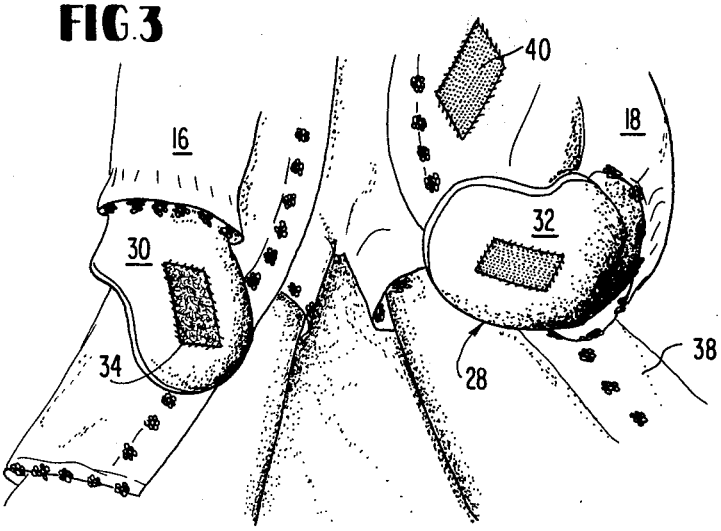
FIG. 3 is a fragmentary view showing positioning of certain of the self adherent patches.
Figure 4:
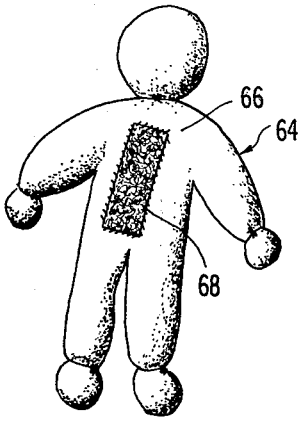
FIG. 4 is a plan view of the baby doll from the rear.
Figure 5:
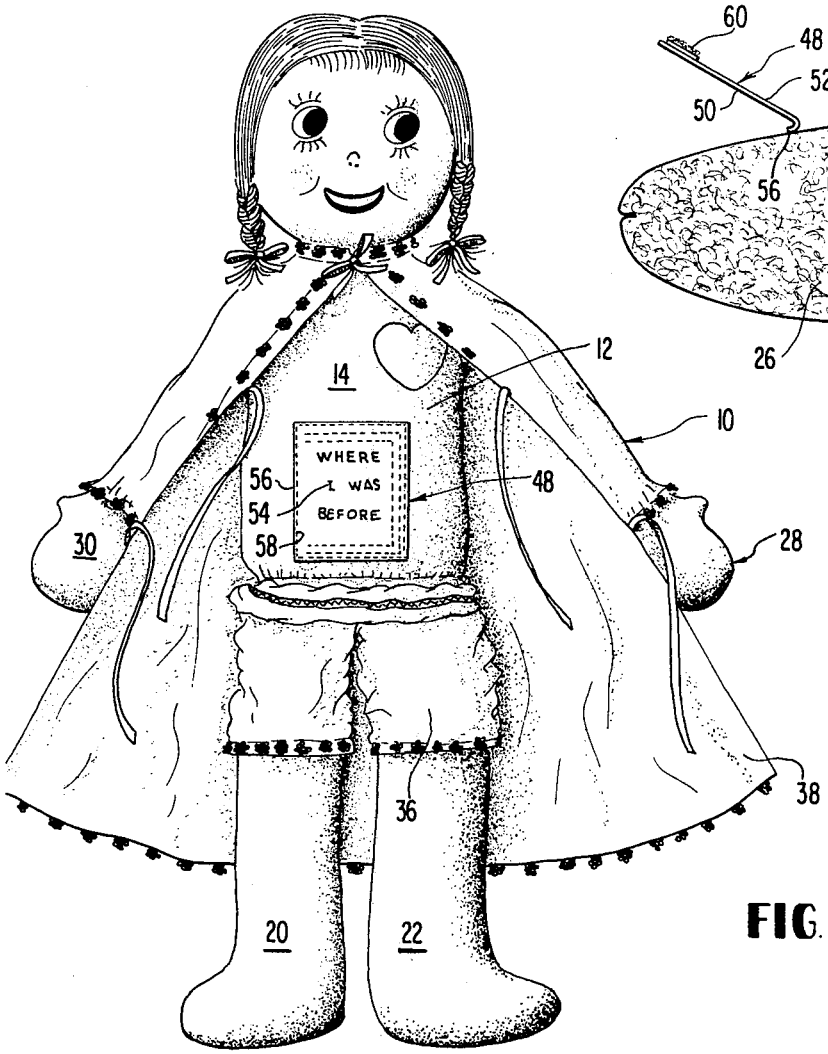
FIG. 5 is a front elevational view of the mother doll.

The arms 16 and 18 each have hand portions 28 with front and back hand panels 30 and 32. As best shown in FIG. 3, patches 34 of adherent material such as that sold under the trademark VELCRO are sewn on the front panel 30 of the hand of the arm 16, and on the back panel 32 of the hand of arm 18. This material includes a plurality of diminutive hook like projections which are interengagable upon contact, and which disengage only upon application of force thereto. The arms 16 and 18 may thus be separated and placed in positions such as those shown in FIGS. 3 and 5, or alternatively connected in cradling position as illustrated in FIGS. 1 and 2. In the latter position, the patches 34 are in engaged with one another.

The main doll is appropriately attired in simulated undergarments 36, and an outer garment 38. On the garment 38 is attached, as by sewing or adhesive, an adherent section 40, also of VELCRO material.

Figure 7:
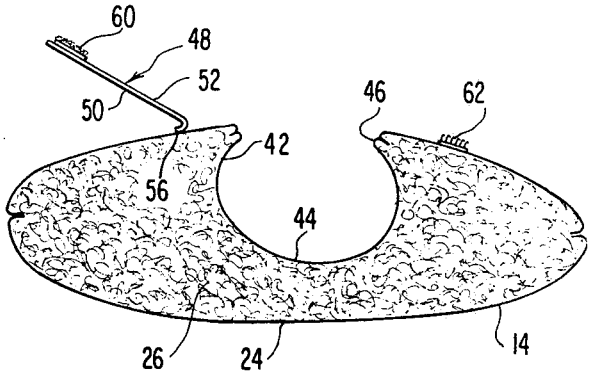
FIG. 7 is an enlarged sectional view on line 7—7 of FIG. 6.
Figure 6:
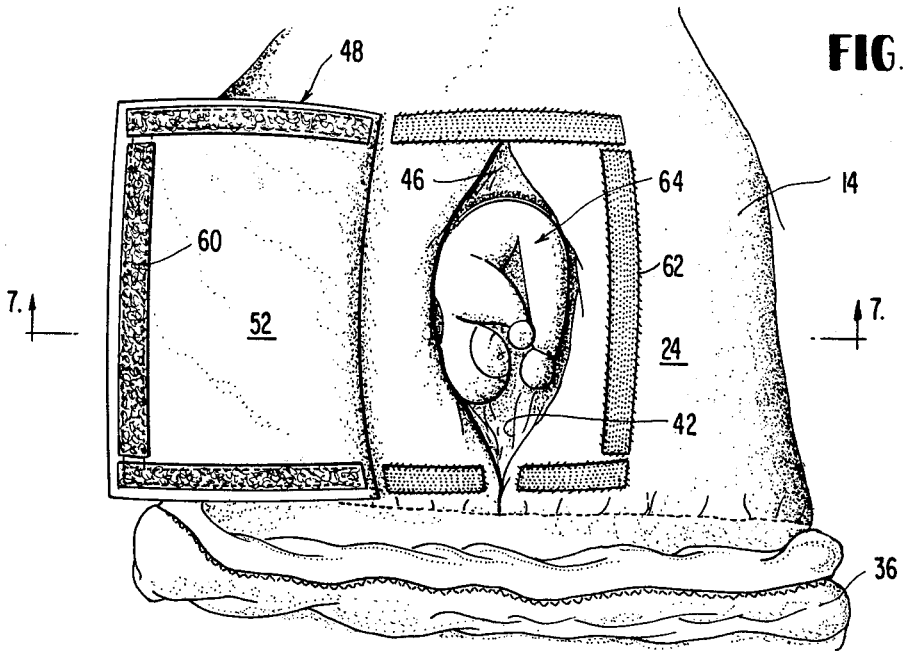
FIG. 6 is an enlarged view of the pouch in open position with the baby doll therein.

Referring to FIGS. 6 and 7, it will there be observed that the trunk 14 has a body cavity 42 formed therein. The cavity is provided with a fabric liner 44, and has an exit opening 46. A door 48 of fabric has a front surface 50 and a back surface 52. On the front surface 50 is indicia 54, such as the expression "where I was before" which is intended to be instructional in nature. The door is affixed hingedly to the cover 24 along one of its edges 56 by a line of stiching 58 or the like. On the back surface 52 of the door are continuous strips 60 of VELCRO material, also attached by stitching, and corresponding strips 62 are placed on the cover 24 in surrounding location relative to the exit opening 46 of the cavity 42. Thus, the door may be closed sealing the cavity (FIG. 5), or opened exposing the opening 46 (FIGS. 6 and 7). When closed, the strips 60 and 62 are engaged.

A small doll 64 is also of stuffed fabric construction, and is thus bendable to selected positions. On its back portion 66, the small doll (which simulates a baby in size relation to the main doll), has a panel 68 of VELCRO material.

The small doll 64 may be bent to fetal position, and placed in the cavity 42, thereby simulating the position of an infant in the womb. Upon opening the door 48, the doll may be removed, and held by engagement of the panel 68 on the adherent section 40 in the cradled position shown in FIG. 2.

I claim:

1. An educational toy comprising:

a doll body having a trunk section, arms,legs, and a head;

the trunk section, arms, legs and head each having a fabric cover and being stuffed with a filler material;

the arms having hand portions with front and back panels;

adherent patches on one front panel of one of the hands, and on the back panel of the other hand;

the arms being adapted for positioning with the adherent patches in contact;

the doll body having a fabric garment thereon, with an adherent section thereon;

the trunk section having a body cavity formed therein, and having a door hingedly secured thereto and adapted to overlie the body cavity;

the fabric cover of the trunk section, and the door having adherent strips to hold the door in said overlying position relative to the body cavity;

a second doll of diminutive dimension relative to the doll body representing a baby and adapted to position in said body cavity; the second doll having a strip of adherent material thereon; and the second doll being attached temporarily to the adherent section on the garment when removed from said cavity.

2. The invention of claim 1, wherein: said adherent patches and sections include a plurality of hook projections.

3. The invention of claim 1, wherein: the door has indicia thereon.

* * * * *